US006168552B1

(12) United States Patent
Eschenbach

(10) Patent No.: US 6,168,552 B1
(45) Date of Patent: Jan. 2, 2001

(54) SELECTIVE LIFT ELLIPTICAL EXERCISE APPARATUS

(76) Inventor: Paul William Eschenbach, 143 Lakeland Ave., Moore, SC (US) 29369

( * ) Notice: Under 35 U.S.C. 154(b), the term of this patent shall be extended for 0 days.

(21) Appl. No.: 09/416,122

(22) Filed: Oct. 12, 1999

Related U.S. Application Data

(63) Continuation-in-part of application No. 09/246,889, filed on Feb. 8, 1999, now Pat. No. 6,024,676, which is a continuation-in-part of application No. 08/971,194, filed on Nov. 4, 1992, now Pat. No. 5,957,814.

(51) Int. Cl.[7] ..... A63B 22/00
(52) U.S. Cl. ..... 482/52; 482/51
(58) Field of Search ..... 482/51, 52, 53, 482/57, 70, 79, 80, 148

(56) References Cited

U.S. PATENT DOCUMENTS 5,383,829 * 1/1995 Miller ..... 482/52
5,562,574 * 10/1996 Miller ..... 482/57
5,685,804 * 11/1997 Whan-Tong et al. ..... 482/51
5,993,359 * 11/1999 Eschenbach ..... 482/51

* cited by examiner

*Primary Examiner*—Stephen R. Crow

(57) ABSTRACT

The present invention relates to a standup exercise apparatus that simulates walking, jogging and climbing with arm exercise. More particularly, the present invention relates to an exercise machine having separately supported pedals for the feet and arm exercise coordinated with the motion of the feet.

Cross trainers guide the feet along a generally elliptical shaped curve to simulate the motions of jogging and climbing. Existing machines often produce user problems such as excessive foot articulation. The present invention is an improved elliptical exercise machine capable of extended exercise with fewer user problems. Further, the cross trainer is adjustable to vary the motion of the elliptical stride from walking to climbing.

The intermediate portion of a foot support member is guided by a guide member and drives a crank linkage on one end with pedal on the other end. The resulting pedal motion has less severe pedal angles than a simple crank cross trainer. Handles are coupled to the foot support member for coordinated arm exercise.

20 Claims, 5 Drawing Sheets

SELECTIVE LIFT ELLIPTICAL EXERCISE APPARATUS

This application is a Continuation-in-Part of previous application Ser. No. 09/246,889 filed Feb. 8, 1999 now U.S. Pat. No. 6,024,676, which is a Continuation-in-Part of Ser. No. 08/971,194 filed Nov. 9, 1992 now U.S. Pat. No. 5,957,814.

BACKGROUND OF THE INVENTION

1. Field

The present invention relates to astandup exercise apparatus that simulates walking, jogging and climbing with arm exercise. More particularly, the present invention relates to an exercise machine having separately supported pedals for the feet and arm exercise coordinated with the motion of the feet. The pedal lift is controlled separately and can be varied.

2. State of the Art

The benefits of regular exercise to improve overall health, appearance and longevity are well documented in the literature. For exercise enthusiasts the search continues for safe apparatus that provides full body exercise for maximum benefit in minimum time.

Recently, a new category of exercise equipment has appeared on the commercial market called elliptical cross trainers. These cross trainers guide the feet along a generally elliptical shape curve to simulate the motions of jogging and climbing. Generally they are large exercise machines with pedals which do not follow the motion of the foot and do not provide for selective foot lift. There is a need for a more compact elliptical exercise machine with favorable pedal articulation and arm exercise. Further, there is a need to adjust lift of the elliptical motion to vary the amount of climb desired by the operator during operation.

Numerous combinations of levers and cranks to combine exercise for arms and feet can be found. Hex in U.S. Pat. No. 4,645,200 combines arm and foot levers for sit down exercise while Bull et al. in U.S. Pat. No. 4,940,233 combines arm and foot levers for standup exercise. Lucas et al. in U.S. Pat. No. 4,880,225 offer oscillating arm levers coupled to the foot crank by a connecting rod. Dalebout et al. in U.S. Pat. Nos. 4,971,316 and 5,000,444 also shows oscillating swing arms coupled to the foot crank by an offset second crank and connecting rod. Lom in U.S. Pat. No. 4,986,533 offers oscillating arms driven by a crank-slider coupled to a foot crank.

Recently, there has been an effort to improve the up and down motion of stair climbers by the addition of horizontal movements. Habing in U.S. Pat. Nos. 5,299,993 and 5,499,956 offers an articulated linkage controlled through cables by motor to move pedals through an ovate path. Both pedal pivots follow basically the same guidance path curve directed by a motor controller. Stearns in U.S. Pat. Nos. 5,290,211 and 5,299,993 shows a stair stepping exercise machine which incorporates horizontal movement using a combination of vertical parallelogram linkage and horizontal parallelogram linkage to guide the foot pedals. The parallelogram linkages serve to maintain the pedal at a constant angle relative to the floor during a pedal cycle. The pedal pivots move through similar undefined, guide paths.

Standup cycling is described in various patents such as U.S. Pat. No. 3,563,541 (Sanquist) which uses weighted free pedals as load resistance and side to side twisting motion. Also U.S. Pat. Nos. 4,519,603 and 4,477,072 by DeCloux describe standup cycling with free pedals in a lift mode to simulate body lifting. Eschenbach in U.S. Pat. No. 5,279,529 shows several embodiments of elliptical pedal motion configured to maintain the heel of the user on the pedal during a substantial portion of the pedal cycle.

Standup pedal exercise is shown in U.S. Pat. No. 4,643,419 (Hyde) and by Jarriel et al. In U.S. Pat. No. D330,236 where pedal platforms move by dual crank motion but remain parallel to the floor. Knudsen in U.S. Pat. No. 5,433,680 shows an elliptical path generating mechanism with pedals having only one pivot allowing the pedal to rotate unconstrained about the pivot as in a bicycle crank.

Standup pedal exercise combined with arm levers attached to the pedals is shown in Kummerlin et al. German Pat. No. 2,919,49 and in Geschwender U.S. Pat. No. 4,786,050. Standup pedal exercise coupled with oscillating swing arms is shown in Miller U.S. Pat. Nos. 5,242,343 and 5,383,829 and in Eschenbach U.S. Pat. No. 5,423,729. All of these exercise machines use pedals having two pedal pivots which are guided by a first circular guide path curve generated by a crank which rotates through one full revolution during a pedal cycle and a second arc guide path curve generated by a rocker link or track.

Recently, numerous elliptical exercise machines have appeared in the patent literature. Rogers, Jr. in U.S. Pat. Nos. 5,527,246, 5,529,555, 5,540,637, 5,549,526, 5,573,480, 5,591,107, 5,593,371, 5,593,372, 5,595,553, 5,611,757, 5,637,058, 5,653,662, 5,743,834 and 5,938,567 shows elliptical pedal motion by virtue of various reciprocating members and geared linkage systems. Miller in U.S. Pat. Nos. 5,518,473, 5,562,574, 5,611,756, 5,518,473, 5,562,574, 5,577,985, 5,755,642 and 5,788,609 also shows elliptical pedal motion using reciprocating members and various linkage mechanisms along with oscillating guide links with control links to determine pedal angles. Ryan et al. in U.S. Pat. Nos. 5,899,833 and 5,947,872 shows art elliptical cross trainer having a forward crank driving a pedal linkage underneath the operator.

Chang in U.S. Pat. No. 5,803,872 and Yu et al. in U.S. Pat. No. 5,800,315 show a pedal supported by a rocker link and driven with a pair of links located under the pedal pivotally connected to a crank. Maresh et al. in U.S. Pat. No. 5,792,026 show a foot support member supported by a rocker link and driven by a double crank mechanism. Lee in U.S. Pat. No. 5,779,598 and Chen in U.S. Pat. No. 5,823,914 show a pedal link driven by two separate cranks. Lin et al. in U.S. Pat. No. 5,769,760 offers elliptical foot and hand motion. Sands et al. U.S. Pat. No. 5,755,643 show elliptical foot motion with folding front post.

Lee in U.S. Pat. No. 5,746,683 shows a foot support member supported on one end with a compound rocker wherein a slider and handle lever support the rocker. Kuo in U.S. Pat. No. 5,836,854 offers a linear foot support member connected on one end to a crank and guided along an arcuate curve under the pedal by a linkage on the other end. Wang et al. U.S. Pat. No. 5,830,112 shows a foot support member sliding on a pivot on one end and attached to a crank on the other that can fold. Chen U.S. Pat. No. 5,823,917 shows a foot support member driven by a crank on one end and supported by a stationary roller on the other. Chen U.S. Pat. No. 5,820,524 offers a slider crank mechanism having a pedal pivotally attached with a control link to articulate the pedal angle.

Chen U.S. Pat. Nos. 5,779,599 and 5,762,588 shows an elliptical pedal movement with a roller interface between the foot support member and crank. Chen in U.S. Pat. No. 5,759,136 shows a foot support member with a moving pedal for adjustable elliptical motion wherein a link from the pedal to the crank can be repositioned to change the pedal stroke length. Kuo U.S. Pat. No. 5,846,166 shows a foot support member guided on one end by a roller and driven on the other end by a four bar linkage. Stearn et al. in U.S. Pat. No. 5,848,954 offers a foot support member pivoted on one end with a lift crank on the other and a pedal moving on the foot support member to generate elliptical type foot motion.

Maresh et al. in U.S. Pat. No. 5,893,820 shows an adjustable lift elliptical cross trainer wherein the operator must interrupt exercise to relocate various pins to alter the pedal motion. Kuo U.S. Pat. No. 5,836,854 shows a foot support member driven by a crank and guided on one end by a linkage hanging from a "Z" shaped bar that may be adjusted. Whan-Tong et al. In U.S. Pat. No. 5,685,804 shows a foot support member with pedal intermediate the ends driven by a simple rear crank having an adjustable ramp forward the operator to vary pedal lift. Eschenbach in U.S. Pat. No. 5,692,994 shows an elliptical cross trainer which has an adjustable upright support member that allows variable pedal motion. Eschenbach in U.S. Pat. No. 5,957,814 shows both an adjustable upright support and adjustable track for elliptical cross trainers.

There is a need for a pedal operated exercise machine that can be safely operated in the standup position whereby the arms and legs can be exercised with the feet moving through a generally elliptical path wherein pedal lift is variable during operation.

It is one objective of this invention to provide an elliptical pedal movement with a crank linkage that reduces the steep pedal angle which can occur with a simple crank. Another object of this invention is to provide arm exercise that is coordinated with the pedal movement which allows pedal lift to be adjusted during operation.

SUMMARY OF THE INVENTION

The present invention relates to the kinematic motion control of pedals which simulate walking, jogging and climbing during operation. More particularly, apparatus is provided that offers variable intensity exercise through a leg operated cyclic motion in which the pedal supporting each foot is guided through successive positions during the motion cycle while a load resistance acts upon the mechanism.

The pedals are guided through an oblong or elongate curve motion while pedal angles are controlled to vary about the horizontal during the pedal cycle. Arm exercise is by arm handles coordinated with the foot pedals.

In the preferred embodiment, the apparatus includes a separate pedal for each foot, each pedal is supported by a foot support member on one end and is pivotally attached on the other end to a crank. A crank completes one full revolution during a pedal cycle and is phased generally opposite the crank for the other foot support link through a bearing journal attached to the framework. A roller is positioned intermediate the ends of the foot support member and makes rollable contact with a guide member. The guide member is pivotally connected to the framework intermediate the ends of the guide member. At one end of the guide member, an actuator or other means for securing the guide member is pivotally connected to one end to raise one end and lower the other or vice versa.

The guide member can be repositioned manually or by actuator. In the case of a manual adjustment means, a hand crank positioned convenient for the operator would operate a screw thread to raise and lower one end of the guide member. The actuator with a suitable control system can be electrically operated with linear movement or other arrangement intended to reposition the guide member during operation to select a different pedal lift.

A pair of handles for arm exercise are pivotally connected to the framework. A pair of connecting links couple the handles to the forward end of the foot support member. It is understood that the handles for arm exercise could be coupled to the foot support member by another means and remain within the scope of the present invention.

In an alternate embodiment, a crank linkage is driven by the forward end of the foot support member which follows an oval path. This crank linkage consists of a pair of crank arms, each with a coupling link and an intermediate coupling link pivotally attached to the forward end of the foot support member to produce an elliptical pedal motion similar to the preferred embodiment with less severe pedal angles. The remainder of apparatus is similar to the preferred embodiment.

Load resistance is applied to the crank in each embodiment by a pulley which drives a belt to a smaller pulley attached to an alternator and flywheel supported by the framework. In each embodiment, the flywheel must overcome the torque provided by the alternator. Adjustment of the alternator control electronics provides variable intensity exercise for the operator.

In summary, this invention provides the operator with stable foot pedal support having adjustable foot lift during operation that simulate walking, jogging and climbing with very low joint impact and coordinated upper body exercise. The handles for arm exercise remain in coordination with adjustments made to the foot pedal motion.

DETAILED DESCRIPTION OF THE EMBODIMENTS

Figure 1:
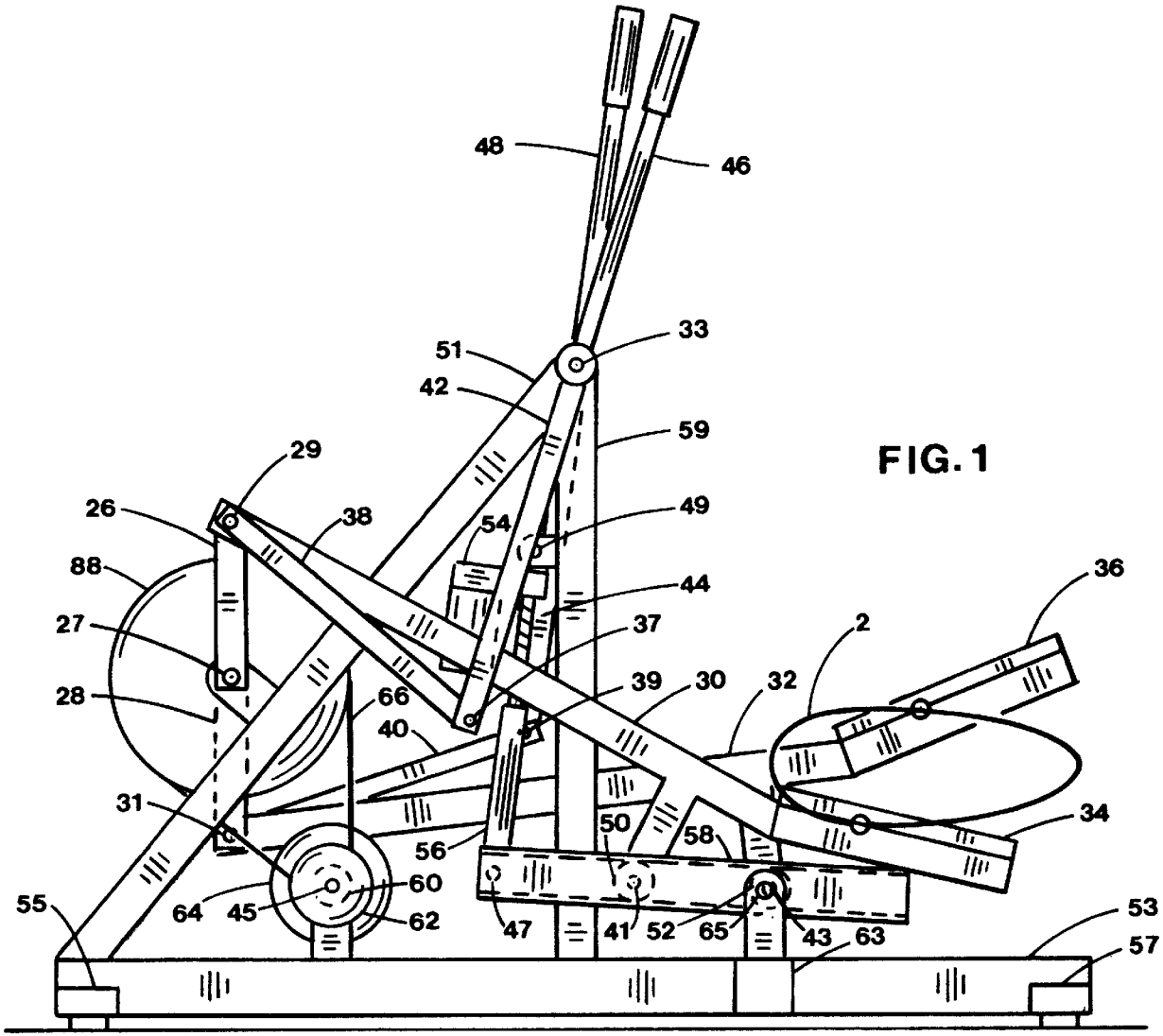
FIG. 1 is a right side elevation view of the preferred embodiment of the exercise machine adjusted to a stride position constructed in accordance with the present invention.
Figure 2:
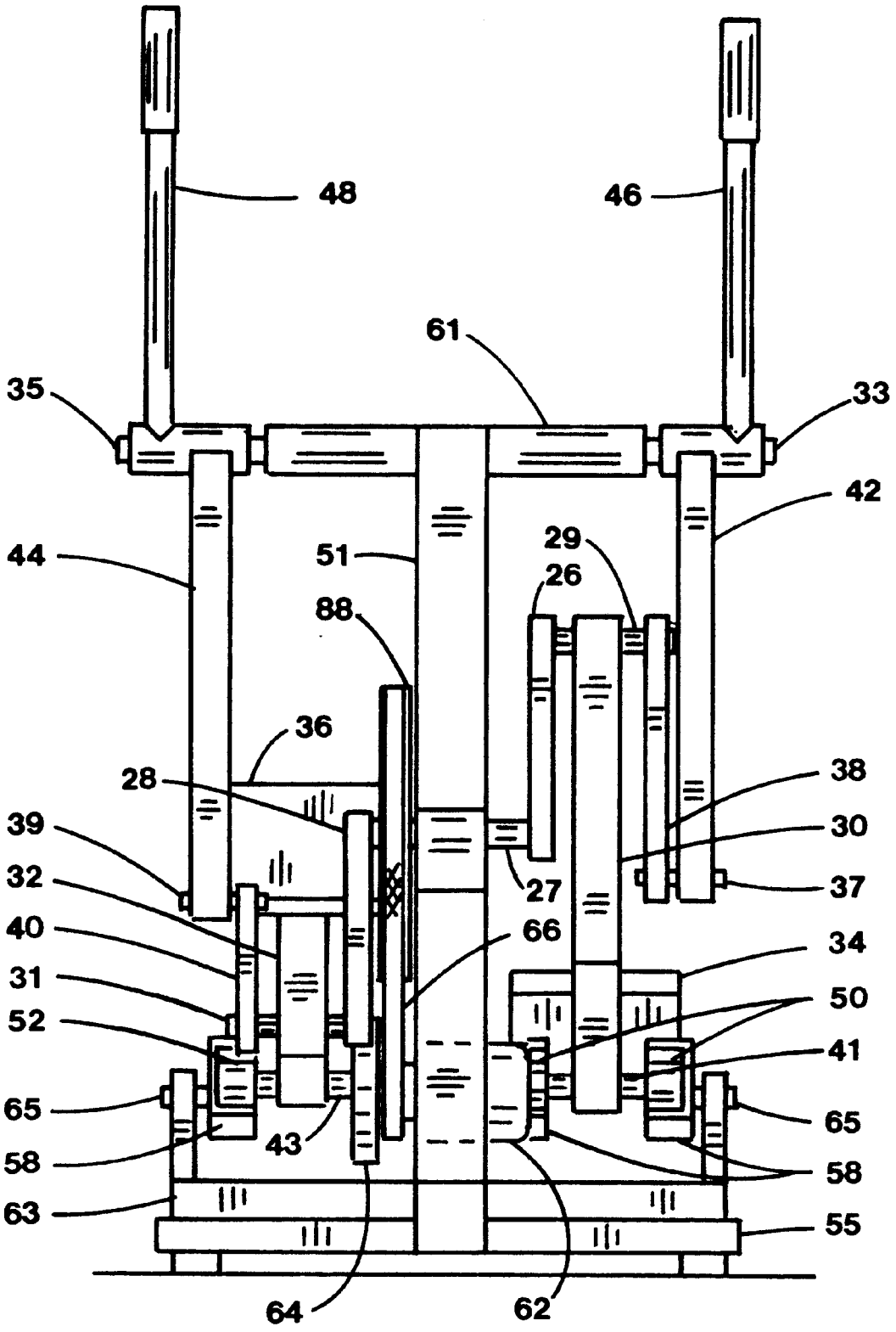
FIG. 2 is the front view of the preferred embodiment shown in FIG. 1.

Referring to the drawings in detail, pedals 34 and 36 are shown in FIGS. 1 and 2 in the lowest and highest positions of the preferred embodiment. Pedals 34 and 36 are attached to foot support members 30,32 at one end. The other end of foot support members 30,32 are connected to crank arms 26,28 at pivots 29,31 which follow an arcuate path. Crank arms 26,28 are joined inside bearing housing and frame member 51 protruding outwardly in generally opposing directions to comprise a crank having crank pivot 27.

Rollers 50,52 are rotatably attached to the foot support members 30,32 intermediate the ends at pivots 41,43. Guide members 58 are pivotally attached to frame member 53 at pivot 65 positioned between the ends of guide members 58. Rollers 50,52 are in rollable contact with guide members 58.

Actuator 54 is attached to frame member 59 at pivot 49 and with actuator extension 56 attached to one end of guide members 58 at pivot 47. Pivot 65 being more towards the middle of guide member 58 allows shorter movement of actuator extension 56 to achieve selective lifts from stride to climb than if pivot 65 were at one end. This more compact guide member movement facilitates positioning the guide member intermediate the foot support member 30,32.

Handles 46,48 for arm exercise are pivotally attached to frame member 63 at pivots 33,35 and extend downward as rocker links 42,44. Connecting links 38,40 connect to rocker links 42,44 at pivots 37,39 and to crank pins 29,31. With the ends of connecting links 38,40 attached at crank pins 29,31, adjustment of the guide members 58 does not effect the movement of the handles 46,48 relative to the framework. Note that the pivot 29,31 connections could alternately be located elsewhere along the foot support members 30,32 which would result in a slight change in handle 46,48 movement with guide member relocations and remain within the scope of this invention.

Frame members 53 connect cross members 55,57 which contact the floor for support of the exercise machine. Frame member 63 attaches to upright support member 59 which connects diagonal frame member 51 to base frame member 53. Load resistance is imposed upon crank arms 26,28 by pulley 88 which drives flywheel 64 and alternator 62 by belt 66 coupled to pulley 60. The flywheel 64 and alternator 62 is supported by the frame member 53 at shaft 45. Other forms of load resistance may also be used.

Application of body weight on the pedals 34,36 causes the pedals 34,36 to follow elliptical stride curve 2 shown in FIG. 1 and together with force applied at the arm handles 46,48 cause the linkage to rotate the flywheel 64 for a gain in momentum. This flywheel 64 momentum will carry the linkage system through any dead center positions of the cranks 26,28. The pedals 34,36 and arm handles 46,48 can be operated to drive the flywheel 64 in either direction of rotation.

Figure 3:
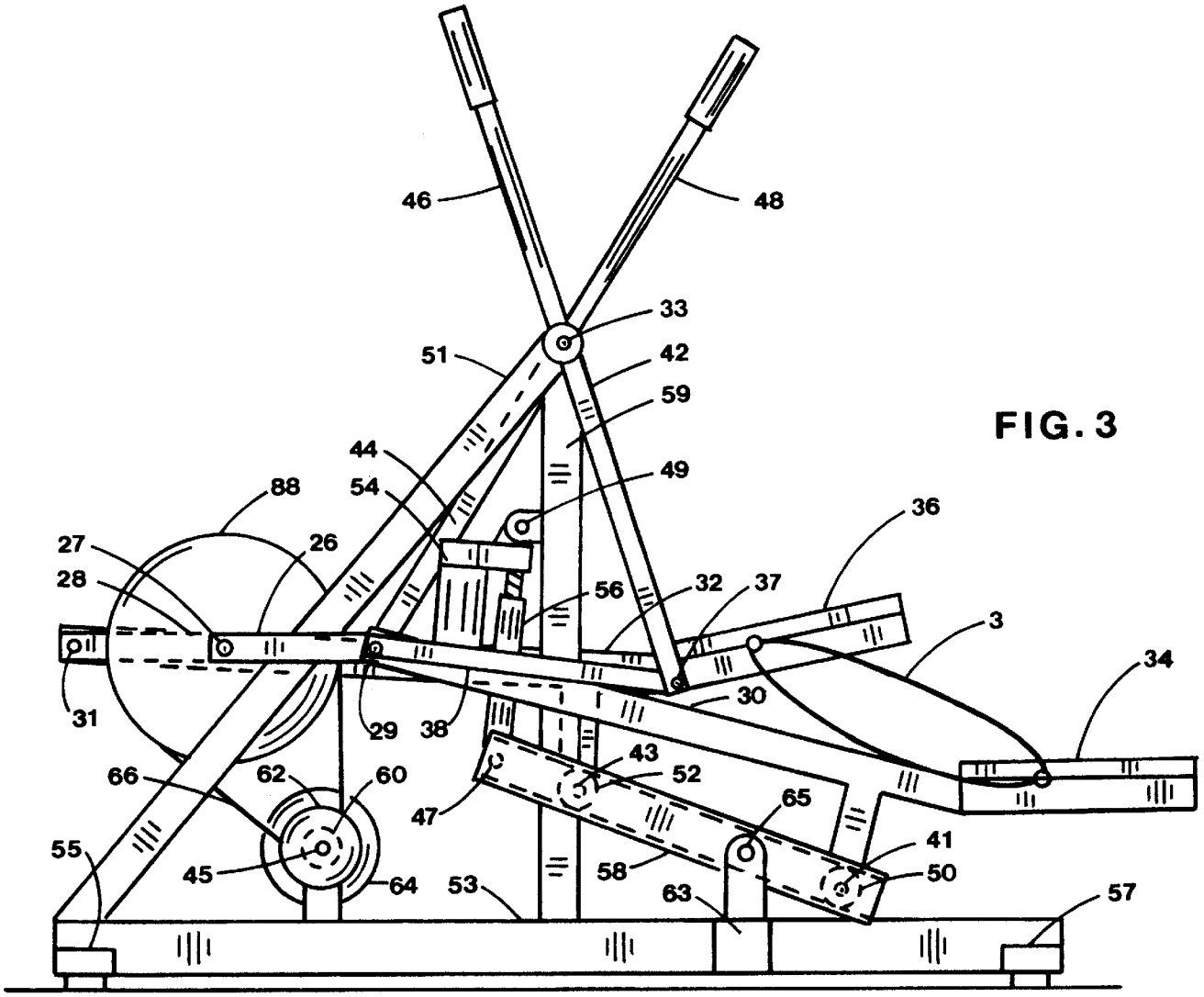
FIG. 3 is a right side elevation view of the preferred embodiment shown in FIG. 1 adjusted to a climb position.

FIG. 3 shows the preferred embodiment with pedals 34,36 in the most forward and rearward positions. Guide members 58 have been rotated about pivot 65 by actuator 54 to increase the slope of guide members 58. The increased slope of the guide members 58 causes the slope of the pedal curve 3 to increase for more pedal 34,36 lift. Handles 46,48 are shown in their most forward and rearward positions which are the same as for the stride position of guide members 58.

Figure 4:
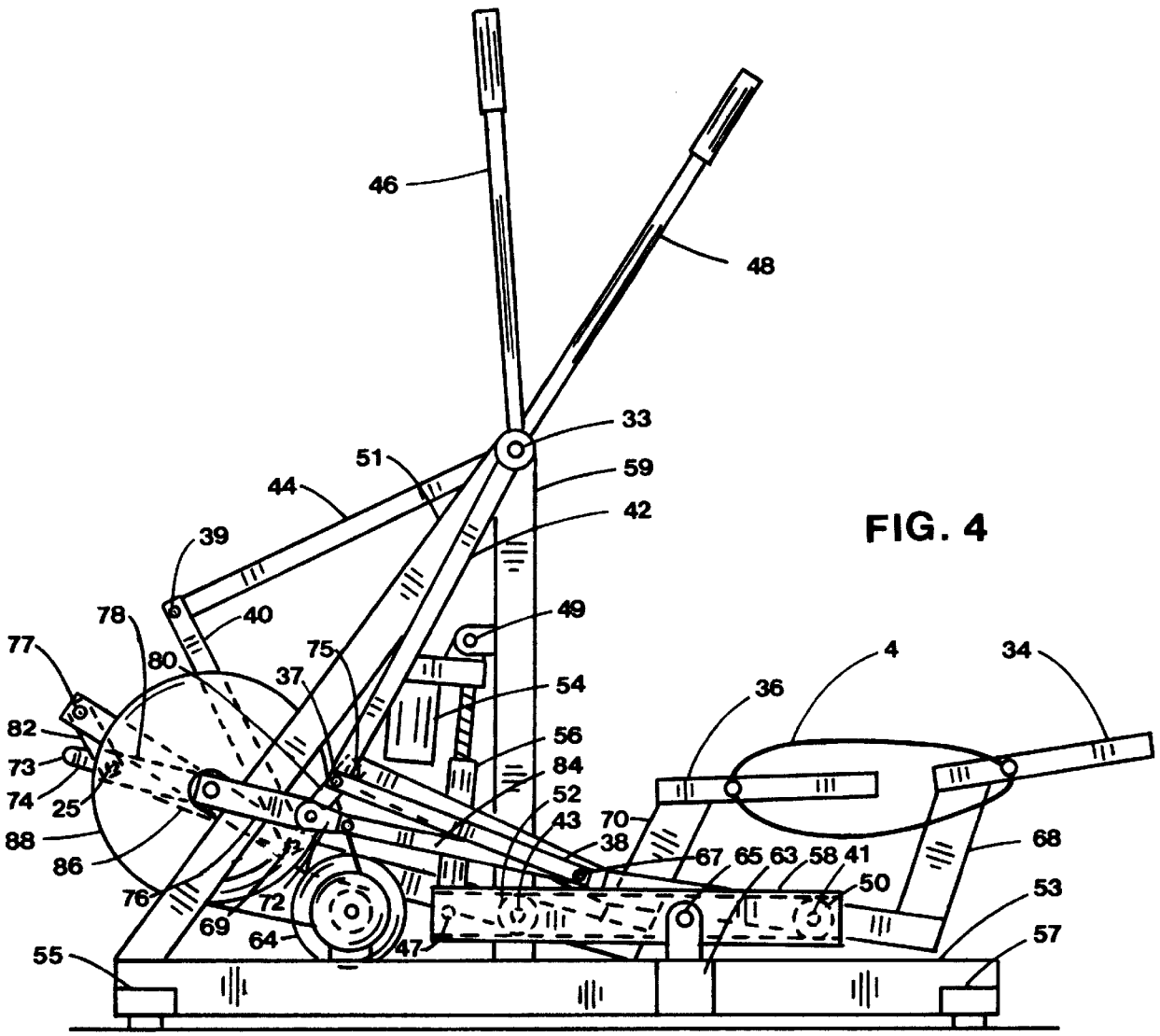
FIG. 4 is a right side elevation of an alternate embodiment adjusted to the stride position.

FIG. 4 shows an alternate embodiment with pedals 36,34 in the most forward and rearward positions. Crank arms 76,78 are joined inside bearing housing and frame member 51 protruding outwardly in generally opposing directions to comprise a crank having crank pivot 27. Further, crank arms 76,78 continue offset 72,74 in length after crank pins 23,25 terminating with pivots 73. Intermediate links 84,86 are pivoted to foot support members 68,70 at pivots 67,69 and to crank arms 76,78 at pivots 73. Coupling links 80,82 are attached to the foot support members 68,70 at pivots 75,77 and to crank arms 76,78 at crank pins 23,25. The connecting links 38,40 are attached to pivots 67,69 on the foot support members 68,70. Guide members 58 are positioned for stride pedal motion elongate curve 4. The remainder of the exercise machine is the same as the preferred embodiment.

Figure 5:
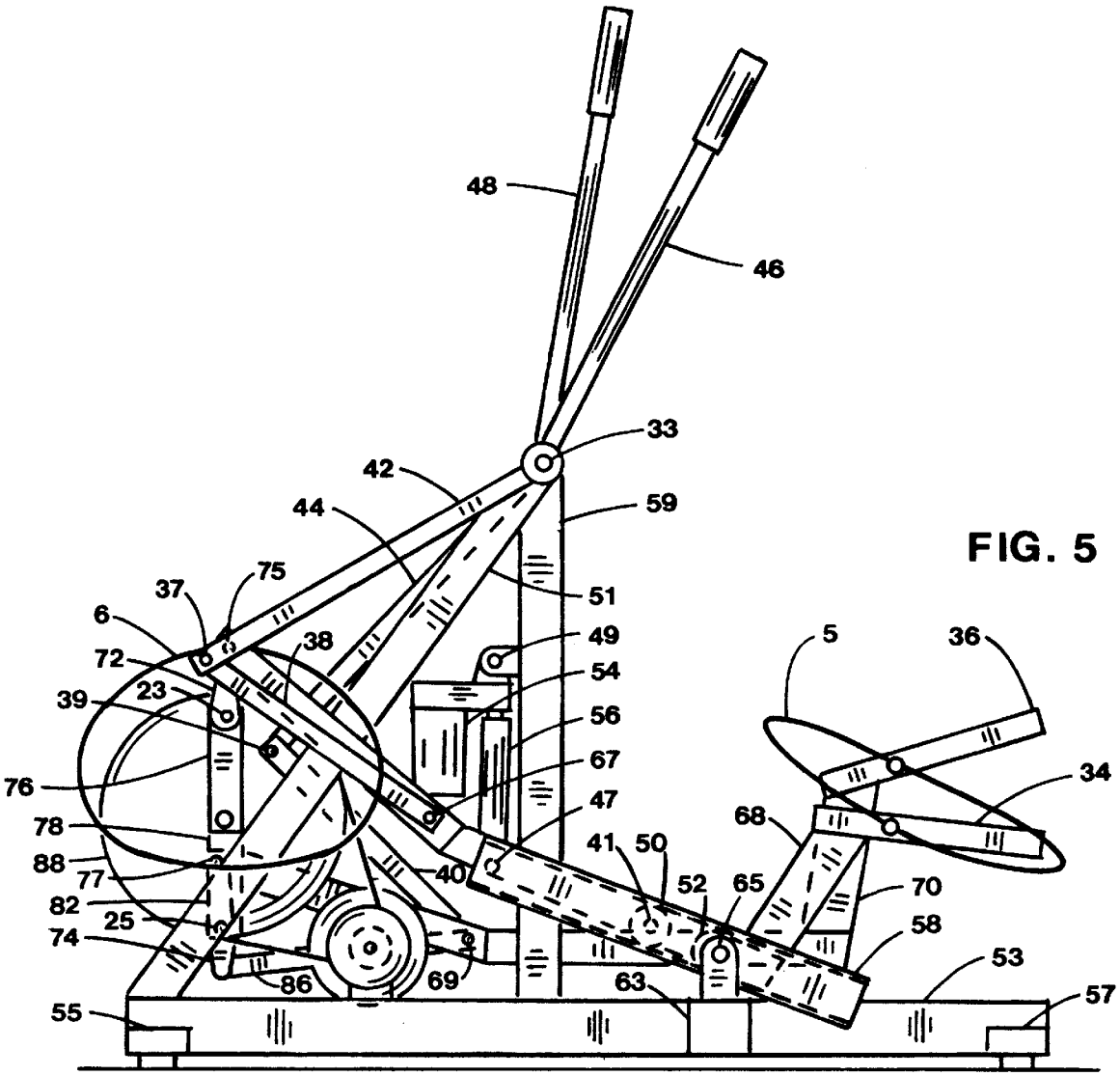
FIG. 5 is a right side elevation view of the alternate embodiment shown in FIG. 4 adjusted to the climb position.

FIG. 5 shows the alternate embodiment of FIG. 4 with guide members 58 adjusted to the climb position as elongate curve 5. Crank arms 76,78 are in their highest and lowest positions. Crank arms 76,78, coupling links 80,82 and intermediate links 84,86, form a pair of crank linkage which causes the first end of each foot support member 68,70 to follow the oval path 6 shown i FIG. 5. The oval path 6 allows less severe pedal 34,36 angles during the upper portion of the pedal ellipse 5.

In summary, the present invention has distinct advantages over prior art because with limited rotation the guide member provides attractive adjustable elliptical pedal motion with arm exercise. The guide member further allows the foot motion to be adjusted separately with little or no change in the arm exercise which can occur during operation of the exercise machine.

The present invention may be embodied in other specific forms without departing from its spirit or essential characteristics. The described embodiments are to be considered in all respects only as illustrative, and not restrictive. The scope of the invention is, therefore, indicated by the claims, rather than by foregoing description. All changes which come within the meaning and range of equivalency of the claims are to be embraced within their scope.

What is claimed is:

1. An exercise machine comprising;

a framework configured to be supported by the floor;

a crank means rotatably connected to said framework forward the operator, said crank means projecting outwardly therefrom on both sides thereof;

a pair of foot support members, each said foot support member having a first end and a second end, said first end operably associated with said crank means, such that said second end of said foot support member follows a generally closed loop curve when said crank means is rotated;

a roller means, said roller means rotatably connected to a respective said foot support member intermediate said ends;

a pair of guide members each having a first and a second end, each said guide member in rollable contact with said roller means and operably associated with said framework;

a pivot means positioned intermediate said first and second ends of said guide member being operatively associated with said framework whereby said guide member may be rotated about said pivot means to change said elongate pedal curve;

a pair of pedal means to support each foot, said pedal means attached to said second end of a respective said foot support member;

means to reposition said guide member, said means to reposition said guide member operably associated with said framework;

said pedal means configured to move relative to said framework when the foot of the user is rotating said crank means whereby said pedal means follows an elongate curve which can be adjusted by said means to reposition said guide member.

2. The exercise machine according to claim 1 wherein said means to reposition said guide member comprises an actuator means, said actuator means having a control system operable during operation of said exercise machine to reposition said guide member.

3. The exercise machine according to claim 1 wherein said means to reposition said guide member comprises a manual selective means, said manual selective means operably associated with said guide member and said framework.

4. The exercise machine according to claim 1 further comprising a load resistance means operably associated with said crank means.

5. The exercise machine according to claim 1 further comprising a means for arm exercise, said means for arm exercise operably associated with said second end of said foot support member.

6. The exercise machine according to claim 5 further comprising a pair of handle means, each said handle means attached to a rocker link pivotally connected to said framework, a pair of connecting links, each said connecting link pivotally connected to said rocker link and operably associated with said foot support member.

7. The exercise machine according to claim 1 further comprising a pair of coupling links for each said foot support member, said coupling links pivotally connected to said foot support member and to said crank means whereby said first end of said foot support member follows an oval path.

8. The exercise machine according to claim 1 wherein said first end of said foot support member follows an arcuate path when said crank means is rotated.

9. An exercise machine comprising;

a framework configured to be supported by the floor;

a crank means rotatably connected to said framework forward the operator, said crank means projecting outwardly therefrom on both sides thereof;

a pair of foot support members, each said foot support member having a first end and a second end, said first end operably associated with said crank means, such that said second end of said foot support member follows a generally elliptical movement when said crank means is rotated;

a roller means, said roller means rotatably connected to a respective said foot support member intermediate said ends;

a pair of guide means, each said guide means in rollable contact with said roller means and operably associated with said framework;

means for arm exercise, said means for arm exercise operably associated with said foot support members;

a pair of coupling links for each said foot support member, said coupling links pivotally connected to said foot support member and to said crank means whereby said first end of said foot support member follows an oval path;

a pair of pedal means to support each foot, said pedal means attached to said second end of said foot support member;

said pedal means configured to move relative to said framework when the foot of the user is rotating said crank means whereby said pedal means follows an elongate curve.

10. The exercise machine according to claim 9 further comprising an actuator means, said actuator means having a control system and being operably associated with said guide means and said framework whereby said control system allows the orientation of said elongate curve relative to the floor to be changed during operation of said exercise machine.

11. The exercise machine according to claim 10 wherein said actuator means is a linear actuator pivotally connected to said guide means and to said framework.

12. The exercise machine according to claim 9 wherein said guide means has a first and a second end;

a pivot means, said pivot means positioned intermediate said first and second ends of said guide means being operably associated with said framework whereby said guide means may be rotated about said pivot means to change said elongate pedal curve.

13. The exercise machine according to claim 9 further comprising a load resistance means operably associated with said crank means.

14. The exercise machine according to claim 9 wherein said means for arm exercise comprises a pair of handle means, each said handle means attached to a rocker link pivotally connected to said framework, a pair of connecting links, each said connecting link pivotally connected to said rocker link and operably associated with said foot support member.

15. The exercise machine according to claim 9 wherein said first end of said foot support member follows an arcuate path when said crank means is rotated.

16. An exercise machine comprising;

a framework configured to be supported by the floor;

a crank linkage rotatably connected to said framework forward the operator, said crank linkage including a plurality of links projecting outwardly therefrom on both sides thereof;

a pair of foot support members, each said foot support member having a first end and a second end, said first end operably associated with said crank linkage to follow an oval path, such that said second end of said foot support member follows a generally elliptical movement when said crank linkage is rotated;

a roller means, said roller means rotatably connected to said foot support member intermediate said ends;

a pair of guide members, each said guide member in rollable contact with said roller means and operably associated with said framework;

a pivot means positioned intermediate said first and second ends of said guide member being operatively associated with said framework whereby said guide member may be rotated about said pivot means to change said elongate pedal curve;

a pair of pedal means to support each foot, said pedal means attached to said second end of said foot support member;

said pedal means configured to move relative to said framework when the foot of the user is rotating said crank linkage whereby said pedal means follows an elongate curve.

17. The exercise machine according to claim 16 further comprising an actuator means, said actuator means having a control system and being operably associated with said guide member and said framework whereby said control system allows the orientation of said elongate curve relative to the floor to be changed during operation of said exercise machine.

18. The exercise machine according to claim 16 further comprising a means for arm exercise, said means for arm exercise operably associated with said second end of said foot support member.

19. The exercise machine according to claim 18 wherein said means for arm exercise comprises a pair of handle means, each said handle means attached to a rocker link pivotally connected to said framework, a pair of connecting links, each said connecting link pivotally connected to said rocker link and operably associated with said foot support member.

20. The exercise machine according to claim 16 wherein said crank linkage comprises a pair of crank arms and;

a pair of coupling links for each crank arm, said coupling links pivotally connected to each said foot support member and to each said crank arm.

* * * * *